US007972249B1

(12) United States Patent
Napalan

(10) Patent No.: US 7,972,249 B1
(45) Date of Patent: Jul. 5, 2011

(54) GYM APPARATUS

(76) Inventor: Paulito B. Napalan, Las Vegas, NV (US)

( * ) Notice: Subject to any disclaimer, the term of this patent is extended or adjusted under 35 U.S.C. 154(b) by 0 days.

(21) Appl. No.: 12/792,495

(22) Filed: Jun. 2, 2010

(51) Int. Cl.
*A63B 21/008* (2006.01)
*A63B 17/00* (2006.01)
*A63B 69/16* (2006.01)

(52) U.S. Cl. ..... 482/57; 482/904; 482/910; 482/106

(58) Field of Classification Search ..... 482/148, 482/904, 910, 92, 93, 94, 106–109, 51, 57, 482/142
See application file for complete search history.

(56) References Cited

U.S. PATENT DOCUMENTS

| | | | | | |
|---|---|---|---|---|---|
| 2,060,938 | A | * | 11/1936 | Johnson | 482/94 |
| 2,219,219 | A | * | 10/1940 | Boger | 482/130 |
| 2,632,645 | A | * | 3/1953 | Barkschat | 482/38 |
| 3,874,657 | A | * | 4/1975 | Niebojewski | 482/104 |
| 4,257,590 | A | * | 3/1981 | Sullivan et al. | 482/94 |
| 4,293,127 | A | * | 10/1981 | Dudley | 482/120 |
| 4,300,761 | A | * | 11/1981 | Howard | 482/57 |
| 4,431,181 | A | * | 2/1984 | Baswell | 482/38 |
| 4,679,787 | A | * | 7/1987 | Guilbault | 482/54 |
| 4,746,115 | A | * | 5/1988 | Lahman | 482/113 |
| 4,805,901 | A | * | 2/1989 | Kulick | 482/63 |
| 4,828,255 | A | * | 5/1989 | Lahman | 482/142 |
| 4,828,257 | A | | 5/1989 | Dyer et al. | |
| 4,944,506 | A | * | 7/1990 | Keller et al. | 482/54 |
| 4,976,428 | A | * | 12/1990 | Ghazi | 482/133 |
| 4,979,731 | A | * | 12/1990 | Hermelin | 482/70 |
| 5,067,710 | A | | 11/1991 | Watterson et al. | |
| 5,108,088 | A | * | 4/1992 | Keller et al. | 482/5 |
| 5,242,345 | A | * | 9/1993 | Mitchell | 482/94 |
| D358,435 | S | | 5/1995 | Sokol | |
| 5,460,587 | A | * | 10/1995 | Hutchins | 482/101 |
| 5,474,090 | A | | 12/1995 | Begun et al. | |
| 5,591,104 | A | | 1/1997 | Andrus et al. | |
| 5,598,849 | A | | 2/1997 | Browne | |
| 5,669,857 | A | * | 9/1997 | Watterson et al. | 482/54 |
| 5,683,332 | A | * | 11/1997 | Watterson et al. | 482/54 |
| 5,702,325 | A | * | 12/1997 | Watterson et al. | 482/54 |
| 5,704,879 | A | * | 1/1998 | Watterson et al. | 482/54 |
| 5,718,657 | A | * | 2/1998 | Dalebout et al. | 482/54 |
| 5,743,833 | A | * | 4/1998 | Watterson et al. | 482/54 |
| 5,813,947 | A | * | 9/1998 | Densmore | 482/51 |
| 5,860,893 | A | * | 1/1999 | Watterson et al. | 482/54 |
| 5,957,812 | A | * | 9/1999 | Harrigan | 482/8 |
| 6,224,516 | B1 | * | 5/2001 | Disch | 482/54 |
| 6,312,363 | B1 | | 11/2001 | Watterson et al. | |
| 6,458,060 | B1 | | 10/2002 | Watterson et al. | |
| 6,808,475 | B2 | * | 10/2004 | Kehrbaum | 482/54 |
| 6,921,351 | B1 | | 7/2005 | Hickman et al. | |
| 7,066,865 | B2 | | 6/2006 | Radow | |
| 7,575,538 | B1 | * | 8/2009 | Clark | 482/103 |
| 7,780,578 | B2 | * | 8/2010 | Packham | 482/54 |
| 7,794,365 | B2 | * | 9/2010 | Daniel | 482/57 |
| 2003/0017913 | A1 | * | 1/2003 | Stewart | 482/8 |
| 2003/0134718 | A1 | * | 7/2003 | Kim | 482/54 |
| 2007/0213182 | A1 | * | 9/2007 | Anderson | 482/83 |
| 2008/0064577 | A1 | * | 3/2008 | Pederson et al. | 482/140 |
| 2008/0070763 | A1 | * | 3/2008 | Greene | 482/129 |
| 2008/0108482 | A1 | * | 5/2008 | Macey | 482/23 |
| 2009/0181833 | A1 | * | 7/2009 | Cassidy et al. | 482/94 |
| 2010/0160124 | A1 | * | 6/2010 | Berenshteyn | 482/106 |

* cited by examiner

*Primary Examiner* — Steve R Crow

(57) ABSTRACT

A gym apparatus combining a plurality of cardiovascular exercise machines such as a bike system with weight training machines allowing a user to have many different types of exercise equipment and maintain it in a small space. The apparatus features a housing, an extendable Pilates seat component, a foldable wrist exercise, a bike system, a retractable chin up bar; power barbells in the inner cavity of the housing; and a foldable power barbell bar operatively connected to the power barbells via a pulley system.

3 Claims, 5 Drawing Sheets

GYM APPARATUS

FIELD OF THE INVENTION

The present invention is directed to exercise equipment, more particularly to a gym apparatus combining a treadmill, stationary bike, elliptical machine, weight machines, and a Pilates bench in one device.

BACKGROUND OF THE INVENTION

Fitness equipment used in home or commercial gyms ranges from free weights to separate pieces of cardiovascular equipment or weight training exercise equipment. The present invention features a novel gym apparatus that combines a treadmill, stationary bike, elliptical machine, weight machines, and a Pilates bench in one device.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

The present invention features a novel gym apparatus 100 that combines a plurality of cardiovascular exercise machines with weight training machines (e.g., a treadmill, stationary bike, elliptical machine, weight machines, a Pilates bench). The gym apparatus 100 of the present invention allows a user to have many different types of exercise equipment and maintain it in a small space.

Figure 1:
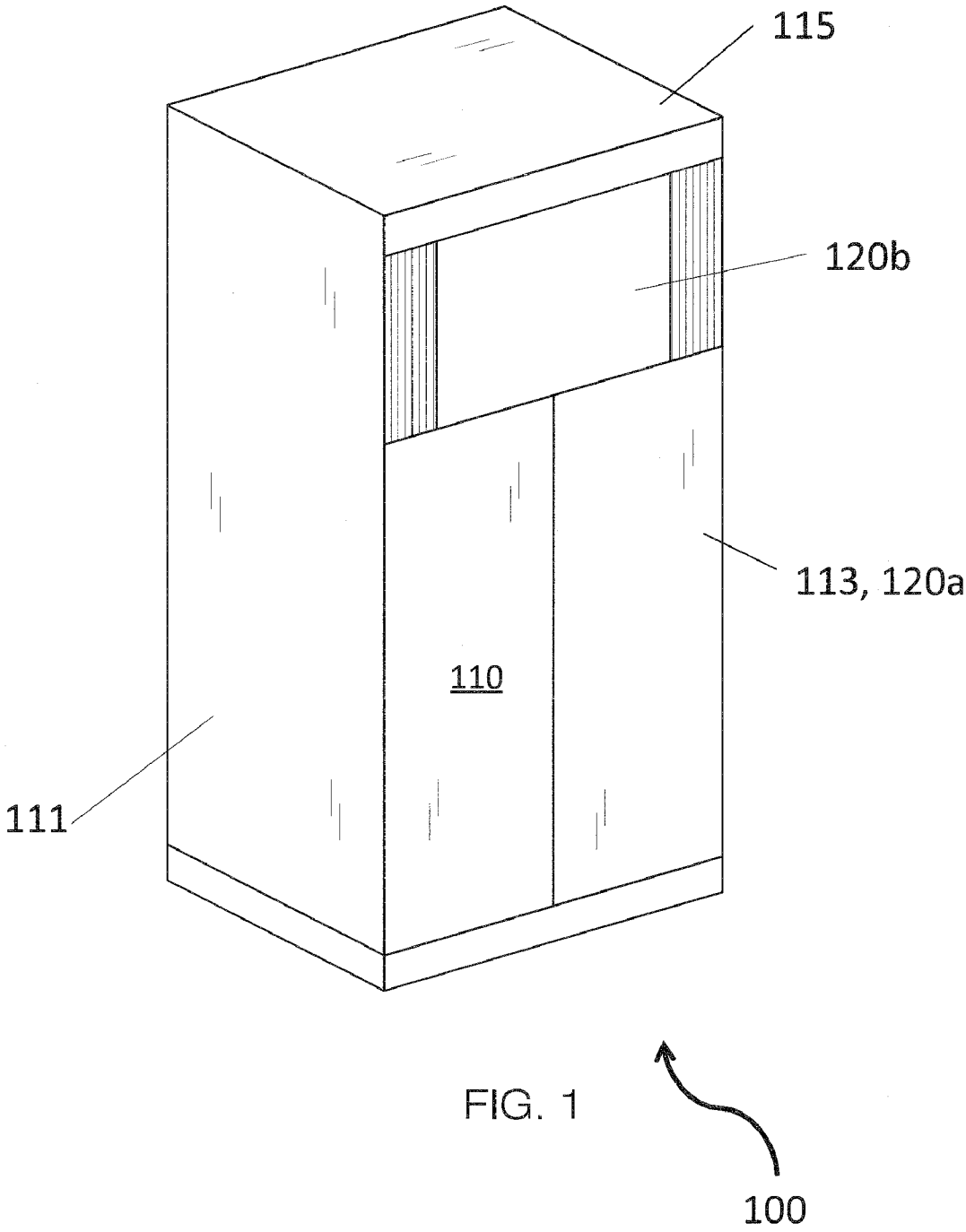
FIG. 1 is a perspective view of the housing of the gym apparatus of the present invention in a closed (e.g., storage) position.

Referring now to FIG. 1, the gym apparatus 100 comprises a housing 110 with an inner cavity for housing various exercise machines. In some embodiments the housing 110 is generally rectangular. The housing 110 is not limited to rectangular housings, for example the housing 110 may be generally cylindrical.

The housing 110 has a first side 111, a second side 112, a front 113, a back 114, a top surface 115, and a bottom surface 116. In some embodiments, one or more doors 120*a*, 120*b* are disposed in the front 113 of the housing 110. As shown in FIG. 1, lower doors 120*a* are positioned near the bottom surface 116 of the housing 110 and upper doors 120*b* are positioned near the top surface 115 of the housing 110. The doors 120 can move between multiple positions including an open position and a closed position respectively allowing and preventing access to the inner cavity of the housing 110.

The housing 110 may be constructed in a variety of sizes. For example, in some embodiments the housing 110 is between about 2 to 3 feet in width as measured from the first side 111 to the second side 112. In some embodiments, the housing 110 is between about 3 to 4 feet in width as measured from the first side 111 to the second side 112. In some embodiments, the housing 110 is more than about 4 feet in width.

In some embodiments, the housing 110 is between about 5 to 6 feet in height as measured from the top surface 115 to the bottom surface 116. In some embodiments, the housing 110 is between about 6 to 7 feet in height as measured from the top surface 115 to the bottom surface 116. In some embodiments, the housing 110 is more than about 7 feet in height.

Referring now to FIGS. 2-5, the gym apparatus 100 of the present invention comprises a seat component 210 extendable from the inner cavity of the housing 110 near the bottom surface 116. The seat component 210 can be adjustable in length and height. In some embodiments, a foldable backrest 212 is pivotally attached to the outer end of the seat component 210 (e.g., via a hinge). In some embodiments, a foldable wrist exerciser 214 is pivotally disposed on the seat component 210, the foldable wrist exerciser 214 can be used to support the seat component 210 in a generally horizontal position (see FIG. 2). A bike system 220 is disposed on the seat component 210. The bike system 220 functions like a stationary bike, which is well known to one of ordinary skill in the art. For example, the bike system 220 comprises a pair of pedals that rotate about an axle.

The gym apparatus 100 of the present invention further comprises a retractable chin up bar 240 that can extend from the inner cavity of the housing 100 near the top surface 115. In some embodiments, a power grip 244 is pivotally attached to or hangs from the chin up bar 240.

The apparatus 100 further comprises a foldable power barbell bar 260 extendable from the inner cavity of the housing 110 above the seat component 210. The power barbell bar 260 is operatively connected to power barbells 265 positioned in the inner cavity of the housing 110 at the bottom surface. Power barbells, barbell bars, and their interconnections are well known to one of ordinary skill in the art. For example, the bar 260 and barbells 265 may be connected via a pulley system, however the present invention is not limited to a pulley system. In some embodiments, a keyboard tray support component 270 is pivotally attached to the power barbell bar 260 (see FIG. 2).

Figure 2:
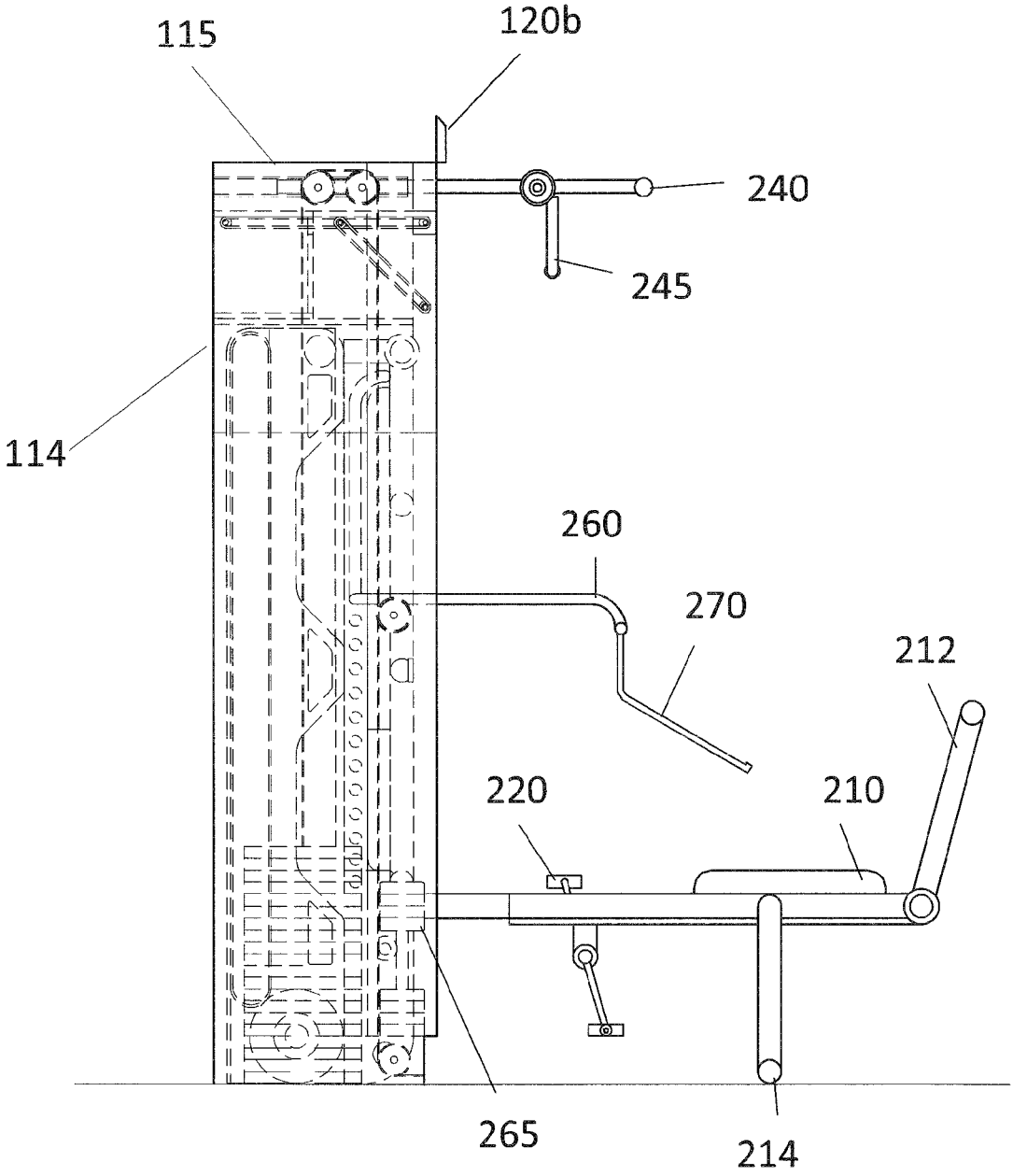
FIG. 2 is a side view of the gym apparatus of the present invention.
Figure 3:
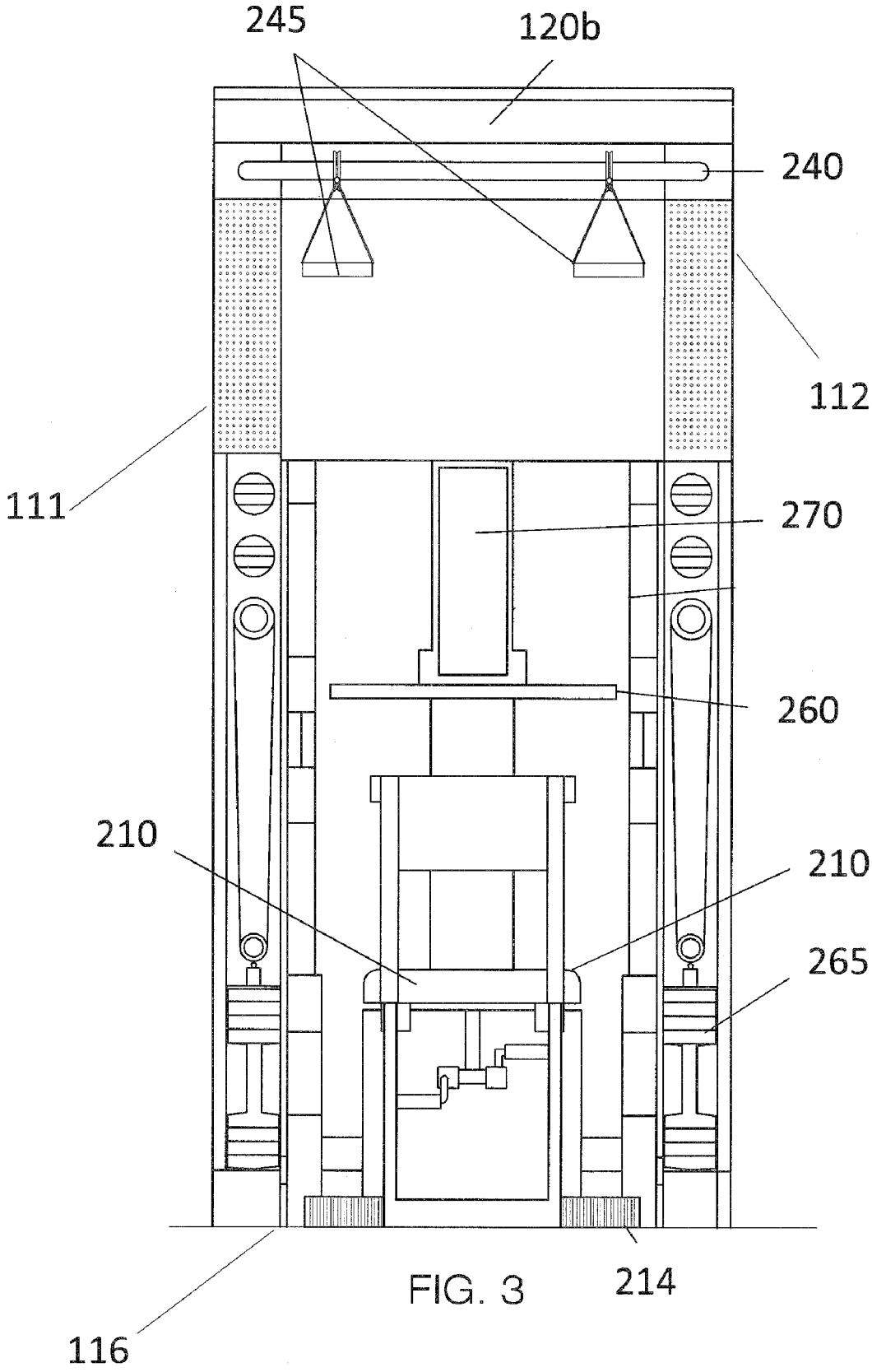
FIG. 3 is a front view of the gym apparatus of the present invention.
Figure 4:
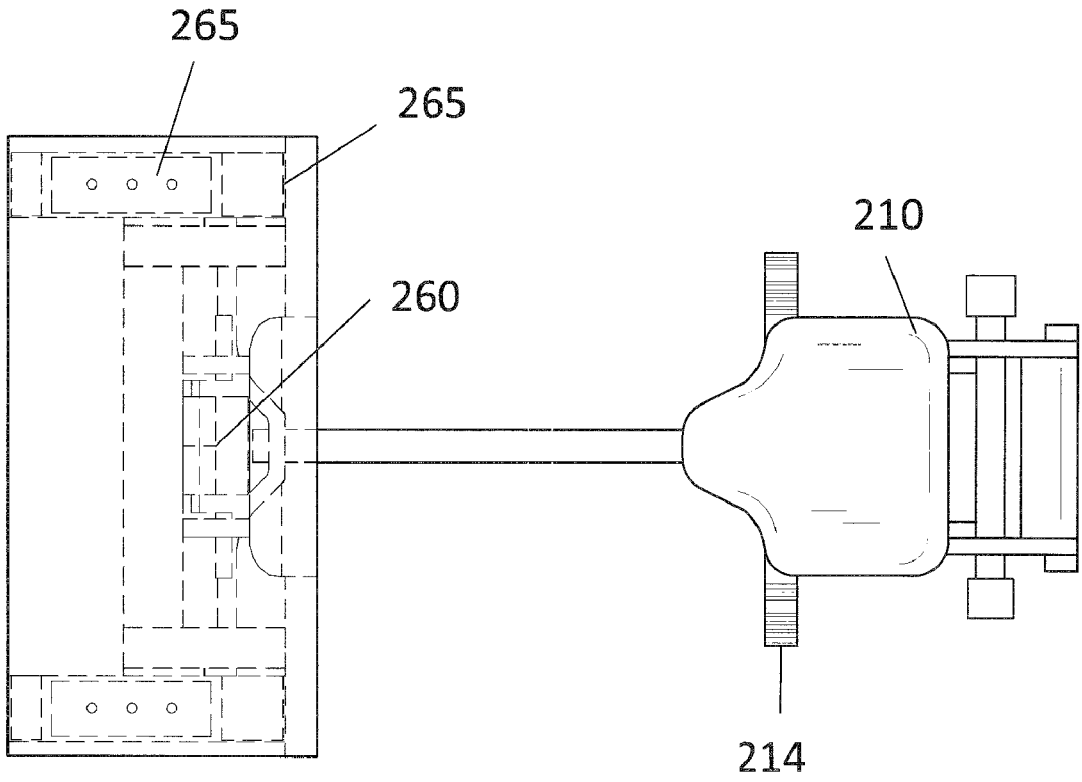
FIG. 4 is a top view of the gym apparatus of the present invention.

The gym apparatus 100 of the present invention can move between multiple positions including a closed position (e.g., a storage position) wherein the door 120 of the housing 110 are closed and the equipment machines are stored in the inner cavity of the housing 110 (see FIG. 1). Referring now to FIG. 2, the gym apparatus 100 can move to a first exercise position wherein the seat component 210 is extended from the housing 110, the retractable chin up bar 240 is extended from the housing 110, and the foldable power barbell bar 260 is extended from the housing 110.

Figure 5:
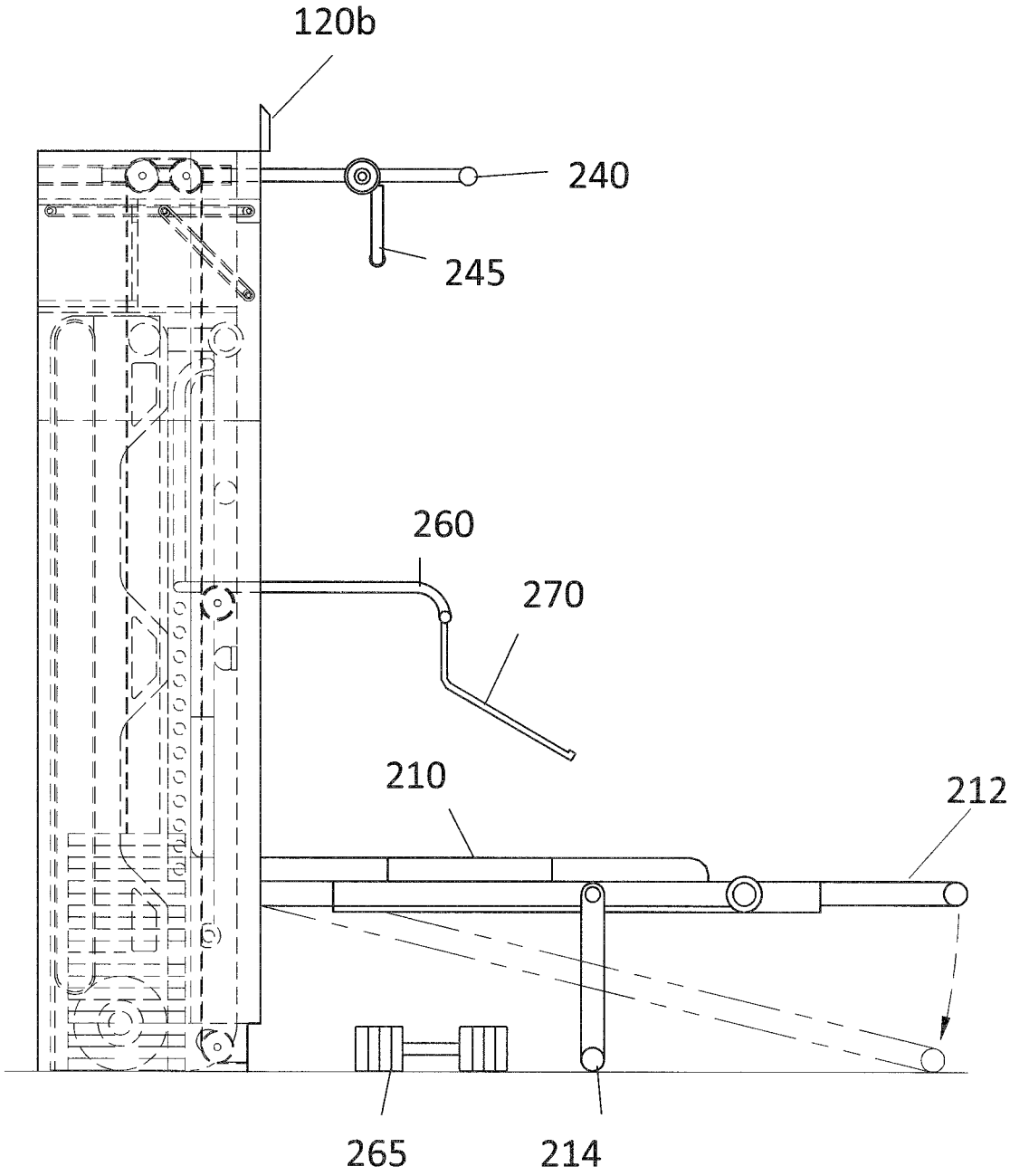
FIG. 5 is a side view of an alternative configuration of the gym apparatus of the present invention.

Referring now to FIG. 5, the seat component 210 may be a power bench (e.g. Pilates bench). In some embodiments, the power barbells 265 can be removed and used as free weights.

In some embodiments, the gym apparatus 100 of the present invention further comprises a stair climbing machine, a treadmill machine, and an elliptical machine.

In some embodiments, the gym apparatus 100 of the present invention may also comprise a computer configured to record a user's heart rate, calories burned, exercises completed, and other parameters of the user's choice. The computer may be configured to share information via the Internet, for example to allow a user to send or receive fitness and training information and/or to interact with a trainer or other individuals using a similar gym apparatus.

In some embodiments, the housing 110 further comprises a screen equipped with a video system. A user may use a DVD player to play a movie, a television show, or watch a training/fitness video. In some embodiments, the gym apparatus 100 further comprises a means of playing games and/or a karaoke system.

The gym apparatus 100 may be constructed from a variety of materials. For example, in some embodiments, the gym apparatus is constructed from a material comprising a metal, a plastic, a wood, the like, or a combination thereof. In some embodiments, the exterior portion of the housing 110 is constructed from a material comprising a stainless steel, a wood, a matte, the like, or a combination thereof.

The following the disclosures of the following U.S. Patents are incorporated in their entirety by reference herein: U.S. Pat. No. 7,066,865; U.S. Pat. No. 6,921,351; U.S. Pat. No. 6,458,060; U.S. Pat. No. 6,312,363; U.S. Pat. No. 5,591,104; U.S. Pat. No. 5,474,090; U.S. Pat. No. 4,828,257; U.S. Pat. No. 5,067,710; U.S. Pat. No. 5,598,849.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A gym apparatus comprising:

(a) a housing having an inner cavity and one or more doors pivotally attached in a front surface, the doors can move between at least an open position and a closed position respectively allowing and preventing access to the inner cavity of the housing;

(b) a seat component extendable from the inner cavity of the housing near a bottom surface, the seat component is a bench with a foldable backrest pivotally disposed on an outer end of the seat component;

(c) a foldable support pivotally disposed on the seat component, the foldable support functions at least to support the seat component in a generally horizontal position when extended from the inner cavity of the housing;

(d) a bike system incorporated into the seat component, the bike system functions like a standard stationary bike;

(e) a retractable chin up bar extendable from the inner cavity of the housing near a top surface;

(f) power barbells disposed in the inner cavity of the housing at the bottom surface; and (g) a foldable power barbell bar extendable from the inner cavity of the housing above the seat component, the power barbell bar is operatively connected to the power barbells via a pulley system, wherein the power barbells can be removed from the housing and pulley system for use as free weights;

wherein the gym apparatus can move between multiple positions including a closed position wherein the doors of the housing are closed and the seat component, the retractable chin up bar, and the foldable power barbell bar are each stored in the inner cavity of the housing, and a first exercise position wherein the seat component is extended from the housing, the retractable chin up bar is extended from the housing, and the foldable power barbell bar is extended from the housing.

2. The apparatus of claim 1 further comprising power grips pivotally attached to or hanging from the chin up bar.

3. The apparatus of claim 1 further comprising a keyboard platform pivotally attached to the power barbell bar.

* * * * *